United States Patent [19]

Hirano et al.

[11] 3,967,940

[45] July 6, 1976

[54] APPARATUS FOR COOLING AND DEHUMIDICATION OF COMPRESSED AIR

[75] Inventors: Itsuro Hirano; Mitsuru Uchiyama; Masao Satoh, all of Tokyo, Japan

[73] Assignee: BF Kogyo Kaisha, Ltd., Tokyo, Japan

[22] Filed: June 13, 1975

[21] Appl. No.: 586,841

[30] Foreign Application Priority Data

June 14, 1974 Japan.....49-67107
Apr. 28, 1975 Japan.....50-50757

[52] U.S. Cl...... 55/122; 55/135; 55/138; 55/227; 55/222; 55/228; 55/257 R; 261/93; 261/153; 261/157

[51] Int. Cl.$^2$..... B03C 3/12

[58] Field of Search ..... 55/9, 10, 122, 138, 55/135, 222, 227, 228, 247, 255, 256, 257 R, 227; 261/93, 153, 157

[56] References Cited

UNITED STATES PATENTS

| | | | |
|---|---|---|---|
| 852,543 | 5/1907 | Deckebach | 55/255 |
| 2,024,226 | 12/1935 | Irwin et al. | 55/122 |
| 3,566,583 | 3/1971 | Ashmore | 55/255 |
| 3,744,217 | 7/1973 | Ebert | 55/118 |
| 3,789,585 | 2/1974 | Arnold et al. | 55/222 |
| 3,884,651 | 5/1975 | Velogol | 55/247 |

FOREIGN PATENTS OR APPLICATIONS

| | | | |
|---|---|---|---|
| 1,308,572 | 10/1962 | France | 55/255 |

OTHER PUBLICATIONS

Washington Post Sunday p. 5 dtd. 8/1/71 Hechinger—Electrostatic Air Cleaner.

*Primary Examiner*—Bernard Nozick
*Attorney, Agent, or Firm*—Blum, Moscovitz, Friedman & Kaplan

[57] ABSTRACT

Apparatus for dehumidification of compressed air, comprising means for forming compressed air into fine bubbles by a nozzle plate and large quantity of long cutting scrap arranged above said plate and on a coiled heat exchange pipe within a cooling tank, thus said bubbles are cooled into dewdrops and the mist in the air is drained by a means to be changed into dehumidified air, which is then taken out and subjected to heat exchange through a heat exchanger arranged outside of the cooling tank, resulting in the air having low humidity.

3 Claims, 3 Drawing Figures

APPARATUS FOR COOLING AND DEHUMIDICATION OF COMPRESSED AIR

BACKGROUND OF THE INVENTION

As a method for dehumidification of air, it is one way to compress and cool the air. This invention belongs to a method for dehumidification of air according to this system.

In case of cooling the air, lower limit of cooling is considered to be down to 0°C to avoid blocking by freezing of the path of air, and the nearer the cooling temperature to 0°C, the more the moisture in the air changes to water drop, so that the effect of dehumidification becomes larger as the water drop is removed. For such a case, it becomes necessary to use a refrigerator usually.

On the other hand, the air to be used in spray painting or the like is better when the humidity of air is lower, and since it is used intermittently, the refrigerator for cooling medium complying with large amount of temporary load will be available with smaller horsepower, when heat exchange is effected by way of water or the like, which has large heat capacity, between the cooling medium and the air (rather than the direct heat exchange through pipe wall), in consideration of the load of cooling medium complying with said intermittent demand of air.

SUMMARY OF THE INVENTION

This invention relates to apparatus for dehumidification of compressed air, wherein compressed warm air is formed into fine bubbles to pass them upward through cooling water, while lowering the temperature of air at low dew point to separate and remove large quantity of moisture and oil, etc.

DESCRIPTION OF THE PREFERRED EMBODIMENTS

This invention was made in view of above described points and will be described in details with reference to the drawings showing an embodiment thereof.

Figure 1:
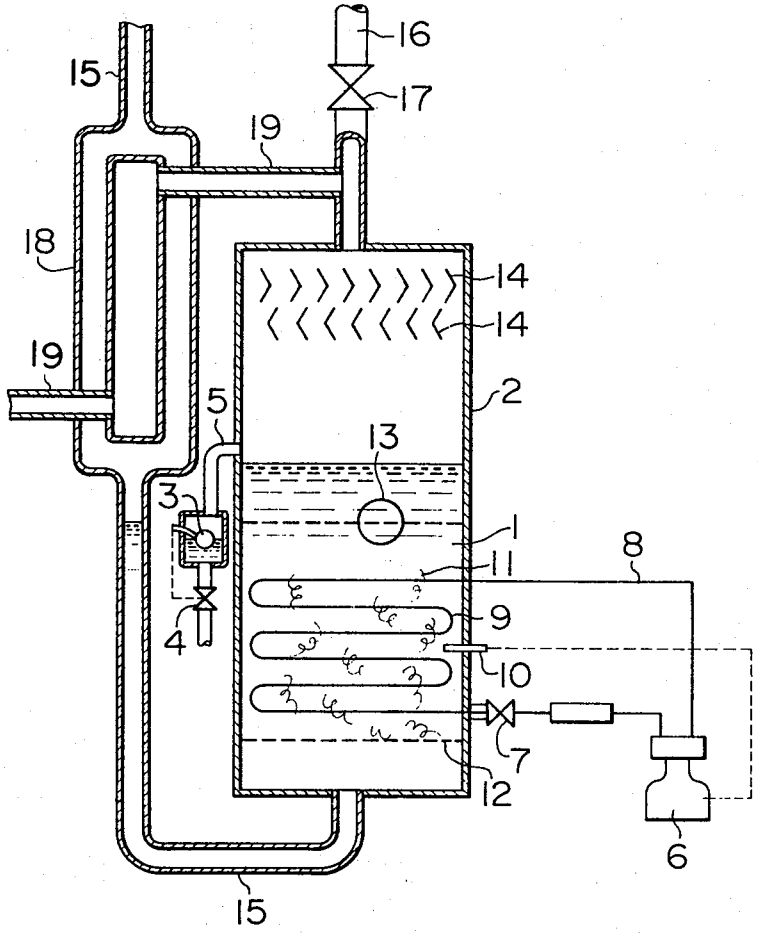
FIG. 1 is a piping drawing, showing an embodiment of the apparatus for dehumidification of compressed air according to this invention.

In FIG. 1, cooling water (1) is stored in the lower part of a cooling tank (2) of closed type, and a drain pipe (5) having a drain valve (4), which may be opened and closed by a float (3), is connected at a position of necessary water satisfying heat exchange in the cold water, and, in the cooling water therein a coiled tube (9) of heat exchange for circulating cooling medium is provided, one end of which tube is connected with a compressor (6) of refrigerator through an expansion valve (7) and other end thereof is connected with the compressor (6) through a return pipe (8), further, on lower part of the cooling tank (2), a thermostat (10) is provided, which will detect upper and lower limit temperatures of the cooling water (1) and operate the compressor (6) as well as stop the same.

Adjacent to lower bottom of the cooling tank (2) and above the bottom in cooling water, there is provided "a means to feed compressed air in the form of bubbles into the cooling water (1)", namely a nozzle plate (12), above which a large quantity of long cutting scraps (11) is arranged as "a means for changing bubbles to finer ones", and a peep hole (13) is provided on outside periphery about middle portion of the cooling tank (2), futher within upper portion of the tank (2) baffle boards (14) for draining are provided as a dehumidifying means for rising air mist.

At the bottom of the cooling tank (2), a supply pipe (15) for compressed air is connected and at upper end of the cooling tank (2), an end of a water supply pipe (16) is connected through a valve (17) to an end of a nipple, of which intermediate portion is connected with an end of outlet pipe (19) for dehumidifying air, which pipe being passed through a swelled pipe (18) provided on an intermediate portion of the supply pipe (15).

This invention is practised by means of above mentioned structure, thereby the dehumidification of compressed air is effected as follows.

At first, the valve (17) is opened to supply cooling water from the supply pipe (16) so as to make the water come up to the peep hole (13), and by operating the compressor (6) of refrigerator, the cooling medium is circulated to the heat exchange coil pipe (9) by way of the expansion valve (7) and the return pipe (8), thus the cooling water (1), which is stored in the lower part of said cooling tank (2), is cooled down to a fixed temperature close to 0°C. After that, compressed air is supplied from the end of supply pipe (15) to the bottom of cooling tank (2), since the nozzle plate (12) is laid near above the bottom of cooling tank (2) and a large quantity of cutting scrap (11) is arranged on said nozzle plate (12), the compressed air supplied to the bottom of said cooling tank (2) is formed into somewhat larger bubbles by means of the nozzle plate (12), then these bubbles are continuously divided into finer ones by means of the long cutting scrap (11), so that they will rise up in the form of fine bubbles in the cooling water (1) without aggregating into larger bubbles. During these stages, the compressed air will sufficiently contact with the cooling water (1) to be cooled and by this cooling the compressed air is cooled down to near 0°C, rising up within the upper portion of cooling tank (2), and when the air pass through the draining baffle boards (14) the mist in the cooled compressed air is changed into dewdrops to be fallen off and is taken out from the end of outlet pipe (19) as cooled air having low humidity. Since the intermediate portion of this outlet pipe (19) is passed through the swelled pipe (18) of the intermediate portion of the supply tube (15), heat exchange between said air and outside inlet air is effected when the former air passes said portion to be changed into compressed air having low relative humidity, which is applicable to spray painting and the like.

On the other hand, said compressed air reaches its dew point due to cooling in the cooling tank (2) and its moisture and oil, etc. is removed thereby, so that water level in the cooling tank (2) rises gradually and the water level will also change according to air pressure, however, the water and oil, etc. reached at certain level will flow into the drain pipe (5), which is connected at a position having sufficient heat to effect heat exchange in the cold water, so as not to exceed the highest water level, thus the drain valve (4) is suitably opened by the float (3) or the like to discharge the water.

Figure 2:
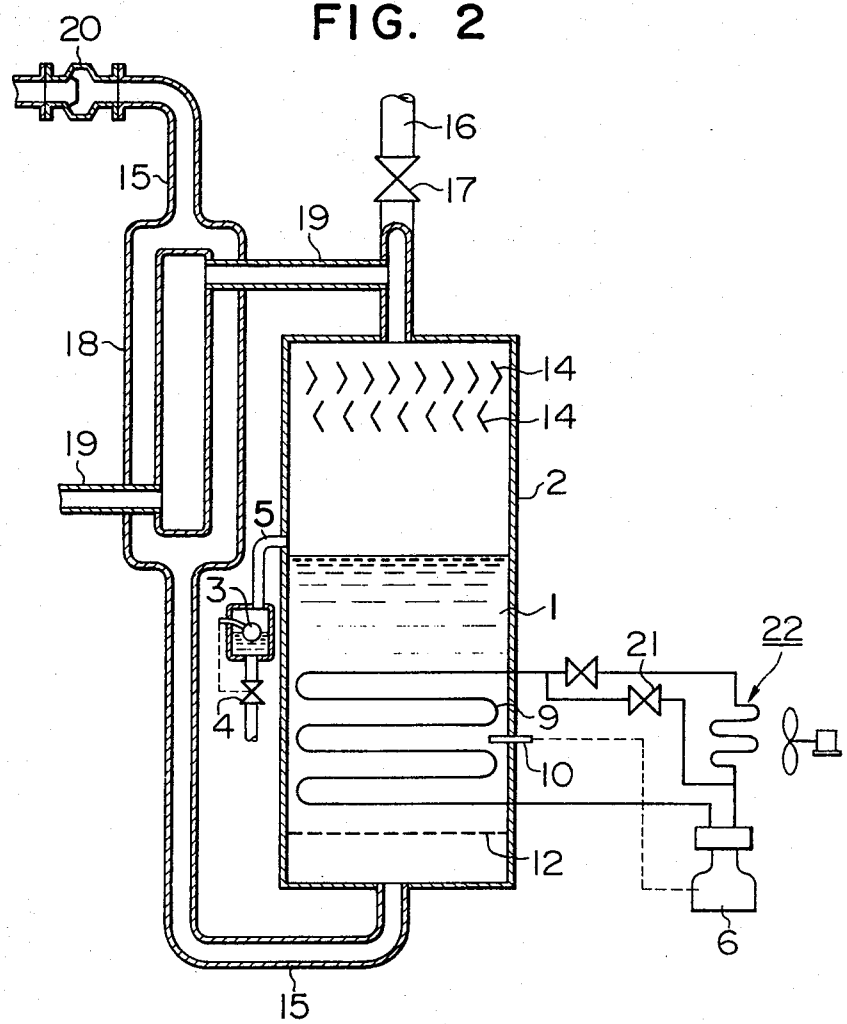
FIG. 2 is an explanatory drawing of the working of the apparatus shown in FIG. 1.

Referring now to FIG. 2, in normal operation of this apparatus, compressed air is supplied from the supply pipe (15), passing through inner portion of the cooling tank (2) and taken out from the outlet pipe (19), however, when air pressure on the side of compressed air source becomes lower than that on the outlet side thereof, the cooling water (1) will flow back to the side of compressed air source, so that a non-return valve (20) is provided on the supply pipe (15) to prevent back flow.

In case of light load, running and stop of the compressor (6) of refrigerator will frequently take place, so that a bypass valve (21) for hot gas is provided to flow hot gas through the heat exchange coil pipe (9) to prevent excessive temperature drop, thus to prevent frequent running and stop of the refrigerator. In FIG. 2, (22) denotes a condensing apparatus.

As described above, this invention is such that the heat exchange of compressed air is efficiently effected in the cooling water (1), which is cooled by the heat exchange coil (9), in the form of fine bubbles, i.e. in the form of bubbles having remarkably large surface for heat exchange per unit volume, while effecting the removal of moisture and oil, etc. in said air too. Since the cooling is effected by way of large quantity of cooling water (1), when this apparatus is used for spray painting and the like, which will intermittently require large quantity of dehumidified compressed air, the apparatus is available with small horsepower, so that this apparatus has excellent function and effect such as extremely economical and so forth.

Further, when outer periphery of the cooling tank (2) is protected to retain cooling, its efficiency will be much raised.

Figure 3:
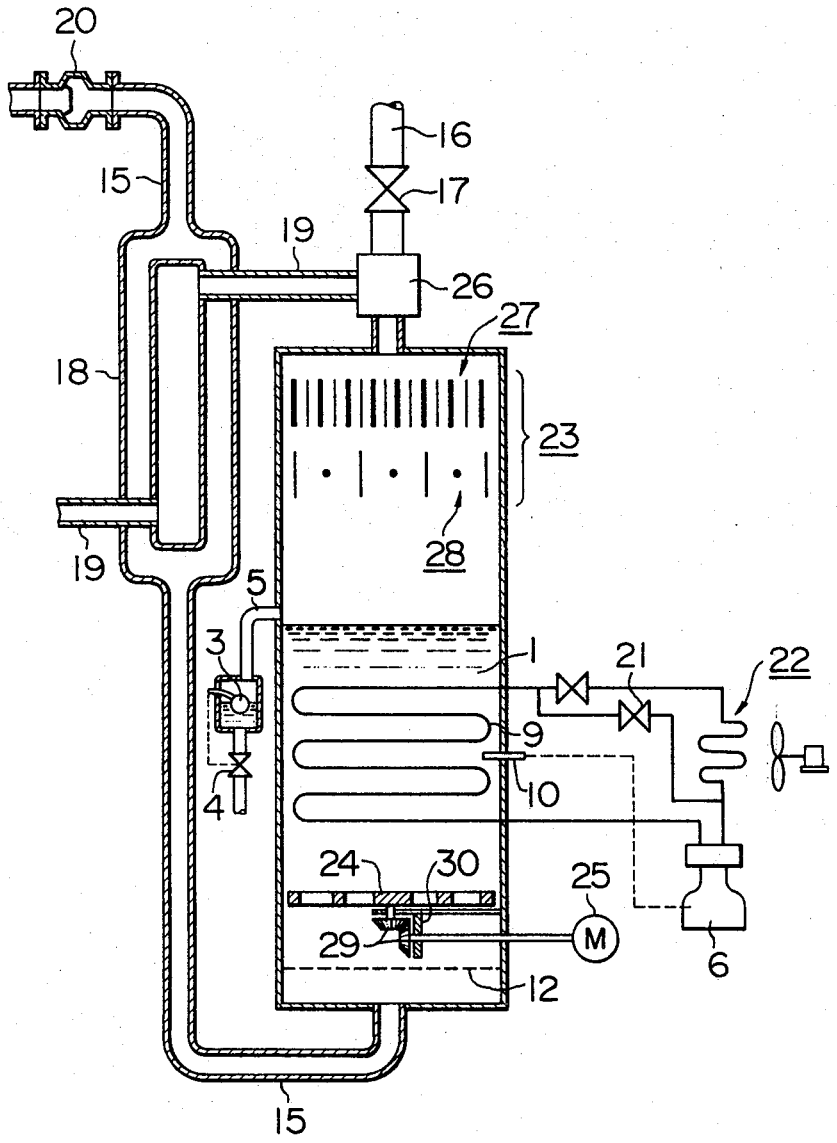
FIG. 3 is a schematic view, showing some other examples in combination as a matter of convenience.

In FIG. 3, there are shown other examples, in which an improved type of electrostatic dust collector (23) comprising collecting portion (27) and ionizing portion (28) is provided instead of said baffle boards (14) and a rotary blade (24) driven by a motor (25) is provided instead of said long cutting scrap (11). And these examples of this invention are shown in combination in one drawing as a matter of convenience.

When a general type of electrostatic dust collector is provided for removing the mist, the collecting portion is apt to spark by the sticking of mist because of small intervals between electrodes, so that one side of pole plates is required to be altered such as by coating with thin insulator. Due to this device, the mist will become waterdrops which will fall against the flow of treating air (the velocity of this counter flow of treating air is not so large).

Further, when any ozone generated in the dust collector becomes harmful, the ozone will be removed in the downstream by passing it through a layer of active carbon (26), which being included in this invention.

In the next place, as shown in FIG. 3, the means for forming bubbles into finer ones is such that relatively larger bubbles came out from the nozzle plate (12) are cut into finer ones by a rotary blade which is driven by a motor (25) at high speed.

Although this means is more expensive than in the case when the long cutting scrap (11) is used, it will afford convenience for controlling the size of finer bubbles more easily. The smaller the diameter of finer bubbles, the better the performance of heat exchange becomes and the more oil and the like will be separated.

The numerals (29) (30) indicate bevel gears for driving the rotary blade (24) and the supporting member thereof, respectively.

What is claimed is:

1. Apparatus for dehumidification of compressed air comprising a cooling tank (2), said tank having a lower portion adapted to be filled with cooling water, inlet means (15) for compressed air connected to said tank at the lower end thereof, a heat exchange coil pipe (9) located in said lower portion of said tank for receiving therethrough a cooling medium for cooling the cooling water, supply means (12) within said lower portion of said tank to form air introduced through said inlet means into bubbles as the air passes through the cooling water and outlet means (19) for compressed air connected to said tank at the upper end thereof, characterized in that dehumidification means (23) in the form of an electrostatic dust collector is provided in the upper portion of said tank for dehumidifying and cleaning air cooled by the cooling water, said dehumidification means including an ionizing portion (28) and a collecting portion (27) positioned above said ionizing portion, said collecting portion including a plurality of facing pole plates, one side of each facing pole plate being coated with an insulator material.

2. Apparatus for dehumidification of compressed air as claimed in claim 1 characterized by supplemental bubble-forming means positioned within said tank above said supply means.

3. Apparatus for dehumidification of compressed air as claimed in claim 2 wherein said supplemental bubble-forming means comprises a blade (24) and means (29, 30) for rotating said blade.

* * * * *